United States Patent [19]

Goodwin et al.

[11] 3,965,720

[45] June 29, 1976

[54] HINGE ADJUSTMENT TOOL

[75] Inventors: Henderson R. Goodwin, Edenton; Edwin G. Wall, Elizabeth City, both of N.C.

[73] Assignee: Westinghouse Electric Corporation, Pittsburgh, Pa.

[22] Filed: July 28, 1975

[21] Appl. No.: 599,493

[52] U.S. Cl. ..... 72/458; 72/479; 254/131

[51] Int. Cl.[2] ..... B21D 11/14

[58] Field of Search ..... 72/458, 457, 479; 254/131; 29/267, 401 R; 7/12; 81/3 R

[56] References Cited

UNITED STATES PATENTS

| | | | |
|---|---|---|---|
| 1,324,693 | 12/1919 | Rush | 72/458 |
| 1,531,001 | 3/1925 | Graves | 72/458 |
| 2,772,587 | 12/1956 | Woodring | 72/458 |
| 3,319,934 | 5/1967 | Dargene | 254/131 |
| 3,332,274 | 7/1967 | Dunster | 72/458 |

*Primary Examiner*—C. W. Lanham
*Assistant Examiner*—Gene P. Crosby
*Attorney, Agent, or Firm*—E. C. Arenz

[57] ABSTRACT

A hinge adjustment tool for use on self-closing hinges for kitchen cabinets has the form of a bar of hot rolled steel in which end portions of the bar are displaced out of the plane of the intermediate portion of the bar in opposite directions at an angle of about 45° by a cold bending operation, the end portions each having a slot opening to one of its longitudinal edges and facing in opposite directions, and with the end portions of the tool being hardened by heat treatment.

2 Claims, 3 Drawing Figures

HINGE ADJUSTMENT TOOL

BACKGROUND OF THE INVENTION

1. Field of the Invention

The invention relates to a tool for adjusting self-closing hinges used on small cabinets such as kitchen cabinets.

2. Description of the Prior Art

The closest prior art of which we are aware is a previously used hinge adjustment tool used commercially in the operations of the assignee of this patent application. The previous tool had appearance similarities to the tool of the present invention in that it also included end portions with slots therein for grasping the hinge structure but was dissimilar in several respects. First, the prior tool had end portions which were bent 90° out of the plane of the intermediate section. The material of which the tool was made was of a character which required that the bar be heated to accomplish the bending. As a result, in heat treating the ends in an effort to harden the end portions containing the slots, a transformation of the material took place which tended to make the end portions very brittle. Thus frequently after the tool had been used perhaps once or twice or only a few more times, the tool would fail with the tongue between the slot and the end of the tool breaking off.

SUMMARY OF THE INVENTION

In accordance with the invention, the tool is formed from a hot rolled steel bar with the end portions being displaced out of the plane of the intermediate section by a cold bending operation and without the application of heat. The end portions are of a hard and tough character as a result of subsequent heat treating.

DRAWING DESCRIPTION

PREFERRED EMBODIMENT

Figure 1:
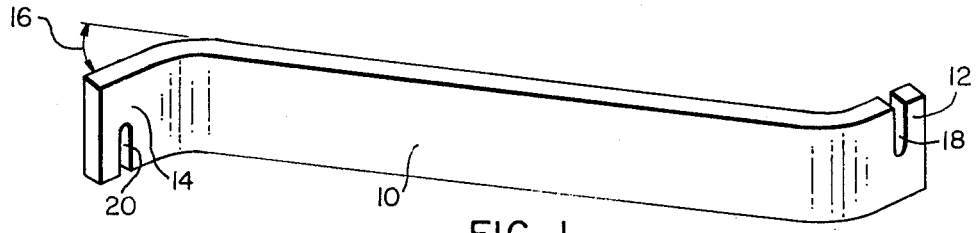
FIG. 1 is an isometric view of a tool according to the invention.

Referring to FIG. 1, the tool of the invention comprises a bar having an intermediate section 10 and opposite end portions 12 and 14 which are displaced out of the plane of the intermediate section 10 at an acute angle which, in the preferred form of the tool, is about 45° as indicated by the angle 16. Each end portion has a slot 18 and 20 opening to a longitudinal edge, the slot 18 opening to the upper longitudinal edge while the slot 20 opens toward the lower longitudinal edge.

Both the material of which the tool is made, and the manner in which it is worked and formed are important to attaining a successful tool. The material is a hot rolled steel such as S.A.E. 1025. The slots 18 and 20 may be machined either before or after the end portions are displaced to their final position. In any event, it is preferred that the bight forming the end of each slot be somewhat rounded as illustrated in FIG. 1. The end portions are bent to their illustrated positions of about 45° out of the plane of the intermediate section by a cold bending operation in a hydraulic press. For a tool having a 3/16 inch thickness and 1 inch wide, a 40 ton hydraulic press has been found to be adequate for bending. It is emphasized that bending is carried out in the absence of any heating of the bar for purposes of facilitating the bending.

After the end portions have been displaced by the cold bending operation, the end portions are hardened by carburizing and then heat treating to toughen, as in the following manner. The bar is heated uniformly to a bright red (about 1650°F or 900°C) and the end portions are then dipped or rolled in a compound to form a fused shell around the area to be hardened. The bar is then again reheated to a bright red and is quenched immediately in cold water with a scrubbing action to ensure the maximum cooling rate. The bar is then further heat treated to harden the case and develop toughness in the core. As a result, the tool has high strength and toughness in its end portions and is resistant to fracture during use.

The physical properties of a tool, according to the invention, which performs satisfactorily, include a tensile strength of 50–60,000 psi; a yield strength of 30–40,000 psi; a percent elongation in 2 in. of 30–40; a percent reduction in area of 55–65; and a Brinele hardness of 115.

Figure 2:
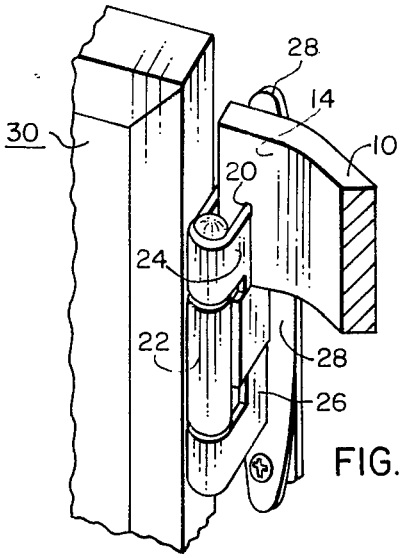
FIG. 2 is a fragmentary isometric view illustrating the use of the tool in adjusting a hinge of a cabinet door in a closed position.
Figure 3:
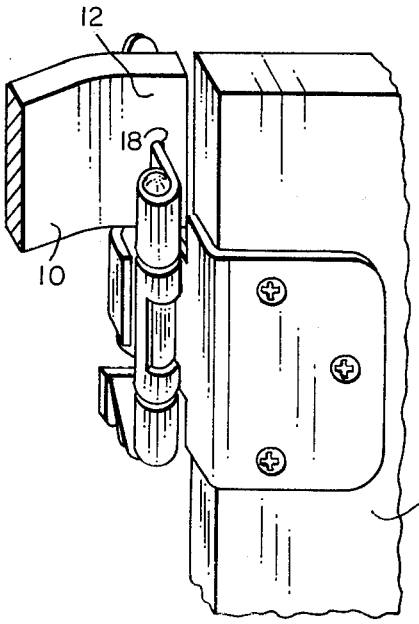
FIG. 3 is an isometric view as in FIG. 2 but illustrating the adjustment of the hinge occurring with the cabinet door in an open position.

The tool is used in the manner illustrated in FIGS. 2 and 3. The tool is used to adjust any gap between doors, such as on kitchen cabinets, and to correct minor misalignments caused by uneven installations.

The doors are adjusted by moving the barrel 22 of a hinge to either the right or left by slightly bending the support sections 24 and 26 which extend between the barrel 22 and the frame wing 28 of the hinge.

To move a door inward, that is to decrease the gap between the meeting edges of a pair of doors, the door 30 is placed in a closed position, as shown in FIG. 2, and the slot 20 of the tool is saddled on the upper support section 24 as shown and then the tool is pivoted in a horizontal plane to the left. Then the tool is removed from the upper support section 24 and the opposite end portion 12 of the tool is placed with its slot 18 straddling the lower support section 26 and the tool again pivoted in a horizontal plane to the left. The same procedure is also carried out with the bottom hinge of the particular door.

For increasing a door gap, the door is placed in an open position as shown in FIG. 3 and the tool is used in the same manner but with the tool being turned in a horizontal plate to the right.

It will be appreciated that not only may door gaps be increased or decreased, but to the extent that the gap shows misalignment of the doors the alignment can also be corrected by use of the tool by bending one hinge in one direction, and the other hinge in the opposite direction if necessary.

What is claimed is:

1. A hinge adjustment tool comprising:

a hot rolled steel bar having heat treatment hardened, opposite end portions projecting out of the plane of the intermediate portion in opposite directions and at an angle between 45° and 75°, said end portions being displaced to the angularly projecting positions by a cold bending operation, each end portion having a slot in one of its longitudinal edges, the slot in one end portion being open to one edge and the slot in the other end portion being open to the other edge.

2. A hinge adjustment tool comprising:

a bar of hot rolled steel having at each end an end portion projecting out of the plane of the intermediate section at an acute angle sufficiently small that said end portion can be bent to said angles by a cold bending said bar and without the application of heat, said end portions projecting out of said plane in opposite directions, one end portion having an upwardly-open slot, and the other end portion having a downwardly-open slot, both slots being generally parallel to the ends of said end portions and each slot being spaced from the end edge of its respective end portion a distance that the material between the slot and the end edge is accommodated between the frame wing and door wing support section of the hinge when the hinge is closed.

* * * * *